United States Patent [19]

Sullivan

[11] 4,290,633

[45] Sep. 22, 1981

[54] LOCK FOR HOUSEHOLD REFRIGERATORS

[76] Inventor: William P. Sullivan, 1400 Farrington Way, Columbia, S.C. 29210

[21] Appl. No.: 82,926

[22] Filed: Oct. 9, 1979

[51] Int. Cl.[3] ..... E05C 5/02

[52] U.S. Cl. ..... 292/114; 292/DIG. 38

[58] Field of Search ..... 292/114, 246, 268, DIG. 38

[56] References Cited

U.S. PATENT DOCUMENTS

| | | | |
|---|---|---|---|
| 863,645 | 8/1907 | Reily | 292/68 X |
| 2,225,722 | 12/1940 | Spieth | 292/136 X |
| 2,702,866 | 2/1955 | Anderson | 292/114 X |
| 3,698,754 | 10/1972 | Means | 292/DIG. 46 |
| 3,909,888 | 10/1975 | Funston et al. | 292/DIG. 38 |

*Primary Examiner*—Richard E. Moore

*Attorney, Agent, or Firm*—Cushman, Darby & Cushman

[57] ABSTRACT

A locking assembly for application to the front door of an upright refrigerator, having magnetic means for yieldably retaining the door in closed position, which includes an elongated locking member having an elongated pivot slot in one end thereof and a locking hook on the other. The assembly also includes a pair of substantially identical pivot and keeper members, both adapted for adhesive securement, the pivot member to the refrigerator and the keeper member to the door. The pivot member extends through the slot in the locking member, while the hook on the latter is engageable with the keeper member.

12 Claims, 4 Drawing Figures

Fig. 1.
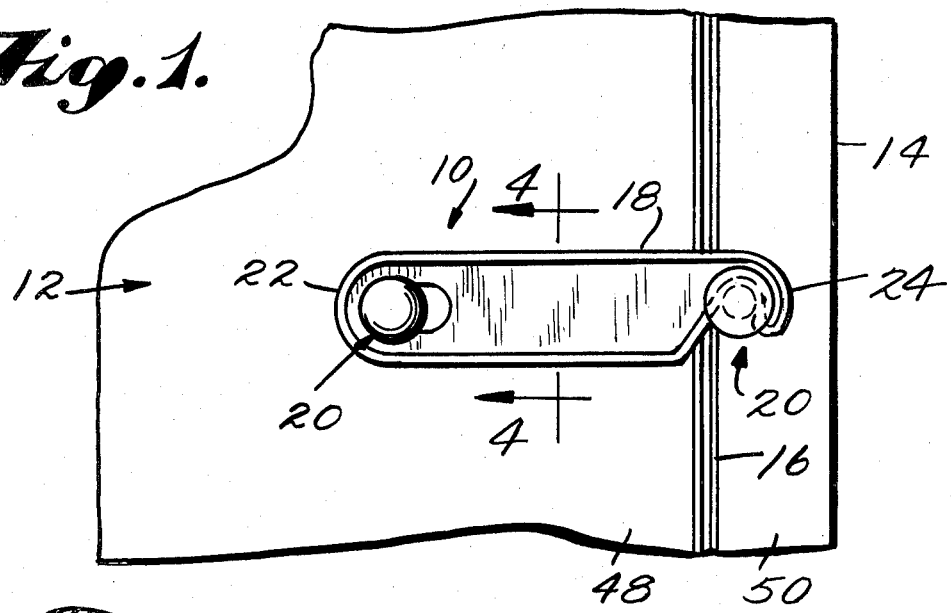
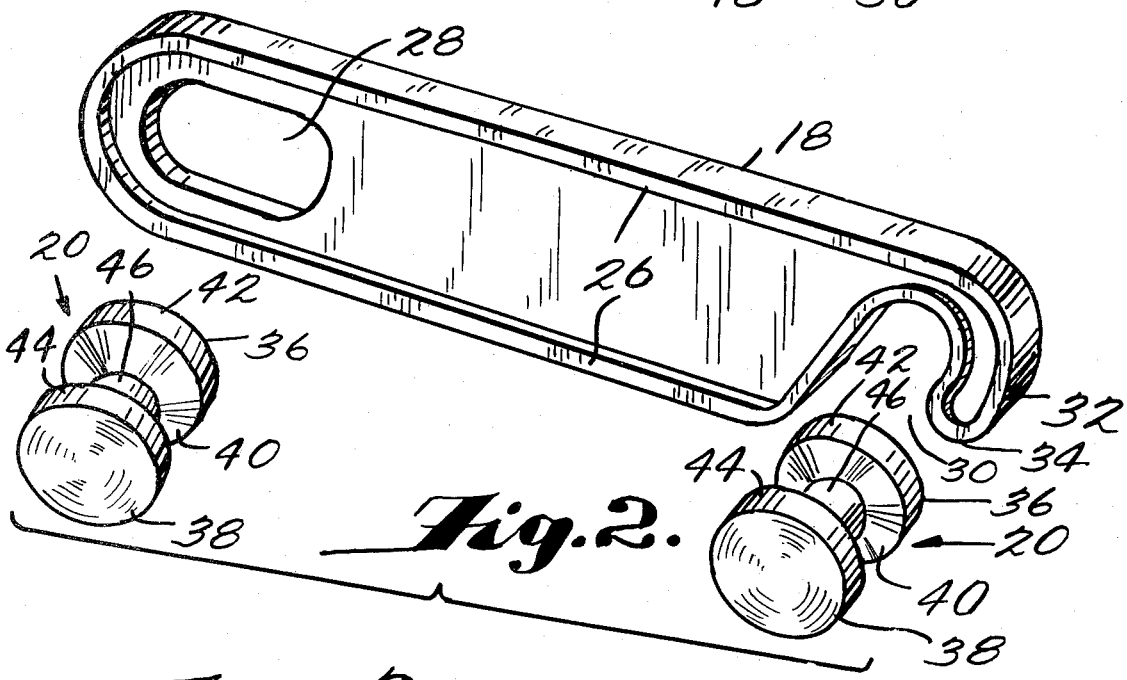
Fig. 2.
Fig. 3.
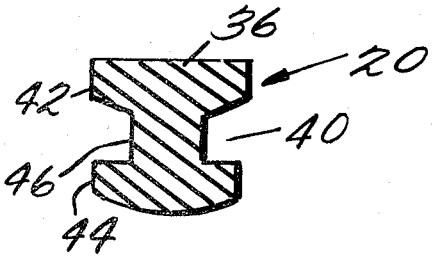
Fig. 4.
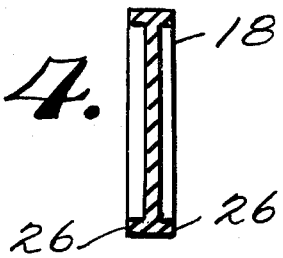

LOCK FOR HOUSEHOLD REFRIGERATORS

FIELD OF INVENTION

This invention relates to devices for releasably locking the front doors of upright refrigerators which have magnetic means for releasably retaining such doors in closed position. In this context, the term "refrigerator" is used generically to cover upright household freezers as well as the freezing section of household refrigerators which have a separate front door for such sections.

BACKGROUND OF THE INVENTION

Today, most upright household refrigerators, including freezing sections thereof, and upright household freezers have doors that are hinged along one side edge for swinging movement on a vertical axis between open and closed positions. Such refrigerators usually are equipped with magnetic means for retaining their doors in closed position. Such doors can readily be opened simply by exerting a pull thereon sufficient to overcome the small retaining force of the magnetic means.

Refrigerator doors that are retained in their closed position only by magnets, as is almost entirely the case with present day household refrigerators, are opened easily by very small children and sometimes even by the pet animals which frequently accompany children. This not only creates a hazardous situation for the child, by reason of his (the term is used herein to include both genders) eating food which might be unhealthy for him and very cold air flowing out over him, but also most likely will result in an unsanitary condition by contamination of the stored food by the child's hands which, as any parent well knows, are usually dirty, in fact sometimes grimy. Furthermore, the pet animals which frequently accompany small children enhance the probability of food contamination by such animals' well-known propensity for eating anything in sight and their ability to climb into a refrigerator to do so.

In addition to the foregoing hazards, the early access to household refrigerator by small children has resulted in a much greater danger, that is, the danger of injury or disfigurement resulting from broken glass or exploding carbonated beverage bottles. In fact, there are recorded instances of fatal injuries to children resulting from their easy access to a household refrigerator.

The opening of a refrigerator door by a small child or a household pet not only creates a hazardous situation, and one which may result in food contamination, but also one which may lead to energy wastage. A small child is of insufficient maturity to appreciate that energy should not be wasted and, hence, once he opens the door, in all probability will leave it open for a long period of time and, thus, waste energy. In this connection, it will be appreciated that when a refrigerator door has been open long enough, all of the cold air in the refrigerator will flow out and be replaced with air of room temperature. Once the door is closed, considerable energy must be expended to lower the interior temperature of the refrigerator back down to normal.

It also will be appreciated that a small child, unappreciative of the fact that most food stored in a refrigerator will spoil rather rapidly at room temperature, frequently will neglect to close a refrigerator door, once opened by his exploratory hands as a result of his insatiable curiosity and sometimes insatiable appetite, and thus loss of perishable food will occur. A modern upright household freezer can, and often does, store frozen food having a value of at least one thousand dollars ($1,000). A loss of that magnitude is disastrous for many households.

Further, refrigerator doors usually have a resilient compressible sealing gasket interposed between their inner marginal periphery and the outer marginal periphery of the refrigerator surrounding the opening therein closed by the door. Such gaskets normally are not completely sealingly effective unless sufficient compressive force is exerted thereon. Sometimes magnets do not exert sufficient attractive force on the door to achieve the necessary compression of such gaskets to attain the desired sealing effectiveness.

SUMMARY OF THE INVENTION

Accordingly, it is an object of this invention to provide a simple, economical locking device for a refrigerator having a front door that is magnetically retained in closed position, which consists of a minimum number of parts, that can be applied and attached simply and easily to a refrigerator by a housewife, though usually inexperienced and unknowledgeable as to mechanical matters, and which will lock the door for ready release by an adult but which will prevent or minimize the possibility of the door being opened by a small child or a household pet.

Other objects and advantages of the invention will become apparent from the following description and accompanying drawings in which:

FIG. 1 is a fragmentary elevational view showing the application of a locking device embodying this invention to a refrigerator door.

FIG. 2 is an enlarged exploded perspective view of the locking device shown in FIG. 1.

FIG. 3 is a side view of one of the posts shown in FIG. 2.

FIG. 4 is a cross-sectional view taken substantially from line 4—4 of FIG. 2.

Referring now to the drawings, there is shown in FIG. 1 the application of a locking device 10 embodying this invention to a conventional household refrigerator 12 having a front door 14 normally held in its closed position by magnetic means (not shown). The door 14, which normally is relatively thick, i.e., of the order of at least an inch or more, is hinged conventionally to one side of the refrigerator 12 for swinging movement about a vertical axis between open and closed positions, the enclosed position being shown in FIG. 1. The conventional resilient compression sealing gasket 16 is interposed between the inner marginal periphery of the door 14 and the outer marginal periphery of the refrigerator 12 surrounding the opening closed by the door. Such gaskets wholly are secured to the door.

As previously mentioned, the construction and mounting of the doors of household freezers, as well as the doors of separate freezer sections of household refrigerators, are substantially in accordance with the above-decribed construction and mounting of the door 14. Hence, for purposes of this invention, the term "household refrigerator" will be deemed to include upright household freezers and the freezer sections of household refrigerators which have separate doors.

As shown in FIGS. 1 and 2, the locking device 10 embodying this invention includes only three parts, an elongated plate-like latch or locking member 18, and two posts 20, one of which serves as a pivot for one end 22 of the locking member and the other as a knob or keeper for engagement by the hook-like other end 24 of the member. Preferably, these three parts 18, 20, 20 are made of a strong, non-brittle, and somewhat flexible or resilient plastic material which desirably has self-lubricating, non-contaminating and non-corrodable properties. Plastic materials which fulfill these requirements admirably are nylon and Celcon M270-04. The formation of these parts from such plastic material makes them inexpensive to manufacture, package, and assemble, and easy to attach in an operative position on a refrigerator. Desirably, the posts 20, 20 are identical so as to be interchangeable and also to effect economies in manufacture.

While the dimensions of the parts obviously may be varied, the following dimensions have been found suitable for application to almost all sizes of present day household refrigerators. Thus, the locking member 18 is desirably of the order of about $6\frac{1}{2}$ inches long and $1\frac{1}{2}$ inches wide. The thickness of the locking member 18 may be no more than about 0.125 inches, but desirably the locking member is strengthened by outstanding peripheral ribs 26 on its opposite sides, as shown best in FIG. 4, each of the ribs having a width of the order of about 0.125 inches with the overall thickness of the member at the ribs being of the order of about 0.25 inches. Preferably, the opposite ends 22 and 24 of the locking member 18 are rounded, as shown, to both conserve material and improve the aesthetic appearance of the locking device 10. Extending longitudinally in the pivot end 22 of the locking member 18 is an elongated slot 28 having rounded ends, the maximum overall length of the slot being of the order of about $1\frac{1}{8}$ inches and the width of the slot being of the order of about 0.8 inches. Extending inwardly from the lower edge of the locking member 18 adjacent its hook end 24 is an elongated notch 30 having an inner end that is rounded on a radius substantially the same as that of the rounded ends of the slot 28 and having a center on the longitudinal center line of the slot. The center line of the notch 30 is disposed at an angle of the order of about 65° to the longitudinal center line of the locking member 18 while the width of the notch is substantially the same as that of the slot 28. The notch 30 defines, with the adjacent rounded end 24 of the locking member 18, a locking hook 32 having a nose portion that terminates somewhat short of the lower edge of the locking member.

The posts 20 are relatively stubby, being of the order of about 15/16ths of an inch in overall length and preferably are cylindrical, having an overall diameter of the order of about 1 inch so that the posts may be said to be somewhat button-like. One end 36 of each post is flat, while the other end 38 preferably is rounded on a radius of about 3 inches. Between its ends 36 and 38, each post 20 is provided with a circumferential groove 40 having a flat side adjacent the rounded end 38 of the post and a rounded side against the flat end 36 of the post with the radius of the rounded side being of the order of about 3 inches. At its mouth, the groove 40 has a width of the order of about 7/16ths of an inch. The land 42 between the groove 40 and the flat end 36 has a width of the order of $\frac{1}{4}$th of an inch while the land 44 adjacent the rounded end 38 has a width of the order of 3/16ths of an inch. The depth of the groove 40 is of the order of $\frac{1}{4}$th of an inch so that the diameter of its bottom 46 is of the order of $\frac{1}{2}$ inch.

The locking device 10 is intended to be supplied to a purchaser as a package or kit of disassembled parts 18, 20, 20 along with a small readily-openable closed container filled with an appropriate adhesive (not shown) a mounting template (not shown), and instructions (not shown) for installation of the assembly in an operative position on a refrigerator. It has been determined that suitable adhesives are one marketed by the 3M Company under the identification No. CA-8, and one by Oregon-Washington Plywood Corp. under the identification Loctite 430. Both of these adhesives have sufficient bonding strength to maintain the locking device in operative position, as well as being soluble in women's nail polish remover, i.e., acetone, so that spills and smears can be cleaned up readily by a housewife.

For installation, one of the posts 20 is first assembled in the slot 28 in the locking member 18. This can be accomplished by first inserting one side of the land 44 of less width through the slot until one edge of the slot substantially contacts the bottom 46 of the groove and then forcing the opposite side of the land 44 through the slot. The resilience or deformability of the plastic material of the locking member 18 and posts 20, combined with the proportions and configurations of the parts, including the rounded end 38 of the posts 20 readily permits such assembly. When so assembled, it will be seen that the opposite longitudinal edges of the slot 28 are disposed within the groove 40 in the post 20 so that disassembly is possible only by a reverse forcing manipulation. When the device 10 is to be attached to a side 48 of a refrigerator as shown in FIG. 1, the post 20 should be assembled in the slot 28 so that the flat end 36 thereof faces that side 48 of the refrigerator 12 to which the device is to be attached. Preferably, the device is attached to the side of a refrigerator, but it is possible, and in some instances more effective, to attach it to the top (not shown) of a refrigerator.

The next step is to use the template (not shown) supplied with the assembly to determine the locations on a side or top of the refrigerator and a top or side edge of the door where the flat ends 36 of the posts 20 are to be secured. When the device 10 is attached to a side of a refrigerator, it desirably should be located at a height where it cannot be reached by a small child. A top location normally will be completely unreachable by a small child, but a side location is preferred for convenience of manipulation and operation by a person who has attained an age of some responsibility. At these locations, when the locking member 18 is in locking engagement as shown in FIG. 1 of the drawings, the outer end edge of the slot 28 will be engaged against the bottom 46 of the groove 40 in the pivot post 20, while the hook 32 will be engaged with the bottom 46 of the groove 40 in the keeper post 20. When these locations have been determined, the flat ends 36 of the two posts 20 are secured by an appropriate adhesive, one to the side 48, as shown, or top (not shown) of the refrigerator 12 and one to the side 50, as shown, or top (not shown) edge of the door 14. Preferably, the positions of the posts 20 will be such that in a side location a line through the axes thereof will be substantially horizontal, as shown, so that the locking member 18 will be substantially horizontal when in locked position. In a top location, a line through the axes of the posts 20 preferably will be perpendicular to the front of the refrigerator. Once the adhesive has dried and the necessary bond secured, the device 10 will be operative.

When the refrigerator door 14 is closed, the locking member 18 can be turned about the pivot post 20 until the nose 34 of the hook 32 commences to engage over the bottom 46 of the groove 40 on the keeper post 20 secured to the edge 50 of the door 14. A sufficient push on the bight of the hook 32 toward the keeper post 20 will force the nose 34 of the hook 32 against the side of the bottom 46 of the groove 40 which faces outwardly of the refrigerator 12 to create a camming action which will force the door 14 slightly inwardly against its resilient compression sealing gasket 16 so that the hook will engage over the bottom of the groove and thus lock the door shut with some degree of tension in the member to compress the gasket 40 to a slightly greater extent than is attainable by the magnetic means alone. A reverse turning movement of the locking member 18 similarly forces the door 14 slightly inwardly against its resilient compression sealing gasket 16 to enable the hook 32 to be disengaged from the keeper 20 post so that the door can be opened by a sufficient pull thereon to overcome the retaining force of the magnetic means (not shown).

It has been found that in a side location attachment when the keeper post 20 is located about a half an inch above the pivot post 20, there will be about 30% more closing tension applied to the door 14 by the locking member 18 than when the posts are on the same level and when the keeper post is about half an inch below the pivot post, the closing tension on the door applied by the locking member will be reduced to substantially zero, but at the same time, the door 14 still will be retained in locked position so that it cannot be opened without disengaging the locking member from the keeper post. The same result can be attained in a top location attachment by displacing the keeper post to one side of the line, through the pivot post on top of the refrigerator which is perpendicular to the front of the refrigerator.

It thus will be seen that the objects and advantages of this invention have been fully and effectively achieved. It will be realized, however, that the specific embodiment disclosed herein is susceptible of modification without departing from the principles of the invention. Accordingly, the invention encompasses all embodiments falling within the spirit and scope of the following claims.

I claim:

1. A refrigerator having a front door swingable on a vertical axis between open and closed positions and magnetic means for yieldably retaining said door in said closed position;

a pair of relatively short posts, each having a circumferential groove intermediate its ends, the end of one of said posts being adhesively secured to a flat surface on said refrigerator normal to its front with said one post projecting normally from said surface and the end of the other of said posts being adhesively secured to the edge of said door generally normal to said surface with said other post projecting normally from said edge, said posts being adjacent, generally parallel to each other and removed from said vertical axis; and an elongated plate-like locking member of a thickness less than the width of said grooves in said posts, said member having in one end portion thereof an elongated slot extending generally lengthwise of said member, the width of said slot being less than the diameter of said posts but greater than the diameter of the bottom of said post grooves, said member having in its other end portion an elongated notch extending inwardly from one edge of said member to define a locking hook, the width of said notch being greater than the diameter of said bottom of said groove, said member being pivotally and slidably engaged with said one post with the side edges of said slot engaged within the groove therein and said hook being releasably engageable within the groove in said other post, whereby when said hook is so engaged said door is locked shut but when disengaged said door can be opened by a force sufficient to overcome the retaining force of said magnetic means.

2. The refrigerator defined in claim 1 in which the locking member and the posts are made of slightly flexible, non-brittle, strong plastic material.

3. The refrigerator defined in claim 2 in which locking member and the posts are made of one of nylon and Celcon M270-04.

4. The refrigerator defined in claim 1 in which the flat surface is at a height unreachable by a small child.

5. The refrigerator defined in claim 1 in which the flat surface is on the side of the refrigerator.

6. The refrigerator defined in claim 1 in which the flat surface is on the top of the refrigerator.

7. A refrigerator having a front door swingable on a vertical axis between open and closed positions and magnetic means for yieldably retaining said door in said closed position;

a pair of substantially identical members, each having a cylindrical end portion, a cylindrical intermediate portion of lesser diameter coaxial therewith, and a base portion, the base portion of one of said members being adhesively secured to a flat surface on said refrigerator normal to its front with said one member portions projecting normally from said surface and the base portion of the other of said members being adhesively secured to the edge of said door generally normal to said surface with said other member portions projecting normally from said edge, said members being adjacent with their respective portions generally parallel to each other and removed from said vertical axis; and an elongated plate-like locking member of a thickness less than the length of said intermediate portions, said locking member having in one end portion thereof an elongated slot extending generally lengthwise of said locking member, the width of said slot being less than the diameter of said cylindrical end portions but greater than the diameter of said intermediate portions, said locking member having in its other end portion an elongated notch extending inwardly from one edge of said locking member to define a locking hook, the width of said notch being greater than the diameter of said intermediate portions, said locking member being pivotally and slidably engaged with said one member with the side edges if said slot embracing the intermediate portion thereof and said hook being releasably engageable with the intermediate portion of said other member, whereby when said hook is so engaged said door is locked shut but when disengaged said door can be opened by a force sufficient to overcome the retaining force of said magnetic means.

8. The refrigerator defined in claim 7 in which the locking member and the member pair are made of slightly flexible, non-brittle, strong plastic material.

9. The refrigerator defined in claim 8 in which locking member and the member pair are made of one of nylon and Celcon M270-04.

10. The refrigerator defined in claim 7 in which the flat surface is at a height unreachable by a small child.

11. The refrigerator defined in claim 7 in which the flat surface is on the side of the refrigerator.

12. The refrigerator defined in claim 7 in which the flat surface is on the top of the refrigerator.

* * * * *